US005493816A

United States Patent [19]

Willemsen

[11] Patent Number: 5,493,816

[45] Date of Patent: Feb. 27, 1996

[54] COLLAPSIBLE BUILDING BLOCK

[76] Inventor: Thomas Willemsen, P.O. Box 2613, Prescott, Ontario, Canada, K03 1T0

[21] Appl. No.: 201,327

[22] Filed: Feb. 24, 1994

Related U.S. Application Data

[63] Continuation-in-part of Ser. No. 977,859, Nov. 17, 1992.

[51] Int. Cl.[6] ..... E04C 1/00

[52] U.S. Cl. ..... 52/2.11; 52/598; 52/604; 446/104; 446/125; 446/478; 446/487

[58] Field of Search ..... 52/2.11, 2.21, 52/569, 598, 604; 5/449, 450, 474; 446/104, 125, 478, 487

[56] References Cited

U.S. PATENT DOCUMENTS

| | | | |
|---|---|---|---|
| 2,649,803 | 8/1953 | Andre | 446/104 |
| 3,083,877 | 4/1963 | Gash | 5/449 X |
| 3,256,440 | 6/1966 | Stark | 52/2.11 X |
| 4,267,662 | 5/1981 | Gordy | 446/89 |

FOREIGN PATENT DOCUMENTS

| | | | |
|---|---|---|---|
| 481297 | 3/1938 | United Kingdom | 446/125 |

*Primary Examiner*—Carl D. Friedman
*Assistant Examiner*—Christopher Todd Kent

[57] ABSTRACT

An inflatable building block is provided with collapsible sides. Coupling means on the upper and lower faces allow the blocks to be interconnected to form structures. A preferred format relies on pleated sides that will collapse in an accordion-like fashion.

24 Claims, 4 Drawing Sheets

COLLAPSIBLE BUILDING BLOCK

This application is a continuation-in-part of application Ser. No. 07/977,859, filed 17 Nov., 1992.

FIELD OF THE INVENTION

This invention relates to building materials and particularly stackable blocks. More specifically, the invention includes designs for building blocks which may be collapsed for storage. Such blocks are particularly suited as toys for children, but industrial applications exist for the invention as well.

BACKGROUND OF THE INVENTION

Building blocks which are hollow have been disclosed previously. An example is described in the U.S. Pat. No. 5,035,098 to Newsom. In the Newsom patent, molded containers for liquids are made in a shape which allows them to be assembled in a nested fashion to form a wall. It is contemplated that these containers be used to construct wall-forms after they have served as containers to transport fluids, and have been emptied. The Newsome containers are described throughout as being rigid and are not collapsible in any way.

A reference that has issued for a collapsible building element is U.S. Pat. No. 2,990,837 to Cushman. This document describes an air inflated wall structure that may be erected to form a large circular enclosure. Periodically placed internal panels, placed transversely within side walls, constrain the shape of the inflated structure to form the walls of the enclosure. A bottom tube is filled with water in order to provide ballast for the structure.

Other inflated structures are described in the following references:

U.S. Pat. No. 3,432,609 to Duvall

U.S. Pat. No. 4,556,391 to Tardivel et al

U.S. Pat. No. 5,236,261 to Wilbourn et al

None of these references, however, describe a stackable building block which may be inflated to form a stable structure. It is with the objective of providing such a product that this invention has been conceived.

The invention in its general form will first be described, and then its implementation in terms of specific embodiments will be detailed with reference to the drawings following hereafter. These embodiments are intended to demonstrate the principle of the invention, and the manner of its implementation. The invention in its broadest and more specific forms will then be further described, and defined, in each of the individual claims which conclude this Specification.

SUMMARY OF THE INVENTION

In its more general sense the invention comprises a hollow, air-tight, modular, stackable building block for constructing a structure having corrugated or pleating sides which will collapse, and a sealable orifice whereby a fluid filling such as water, air or free-flowing sand may be introduced into and out of the interior cavity formed within the modular building block in order to maintain its shape.

The top and bottom faces of the block are preferably made relatively rigid, as compared to the sides. Such faces are preferably generally horizontally oriented and are provided with complementary connector or coupling means, such as protrusions and depressions formed on the respective top and bottom faces, whereby the blocks can be laid in interfitted courses to form a more stable structure. Ideally, the protrusions and depressions are positioned so that the blocks may be staggered to increase their interlocking strength. Additionally, the protrusions and depressions are preferably positioned to permit construction of walls having corners, and angular deflections from the shape of a simple plane structure. This may include both fixed 90 degree deflections and a range of other deflections extending upwards from zero degrees.

The sides of the block are intended to be collapsible. They may be formed from thin-walled, pleated sheeting. In the pleated format the blocks may be collapsed and expanded in an accordion-like manner.

A preferred manner for fabricating the blocks of the invention is by blow-molding. However, other known suitable fabrication means may alternately be employed.

The foregoing summarizes the principal features of the invention and some of its optional aspects. The invention may be further understood by the description of the preferred embodiments, in conjunction with the drawings, which now follow.

SUMMARY OF THE FIGURES

In drawings which illustrate the embodiments of the invention.

DESCRIPTION OF PREFERRED EMBODIMENTS

Figure 1:
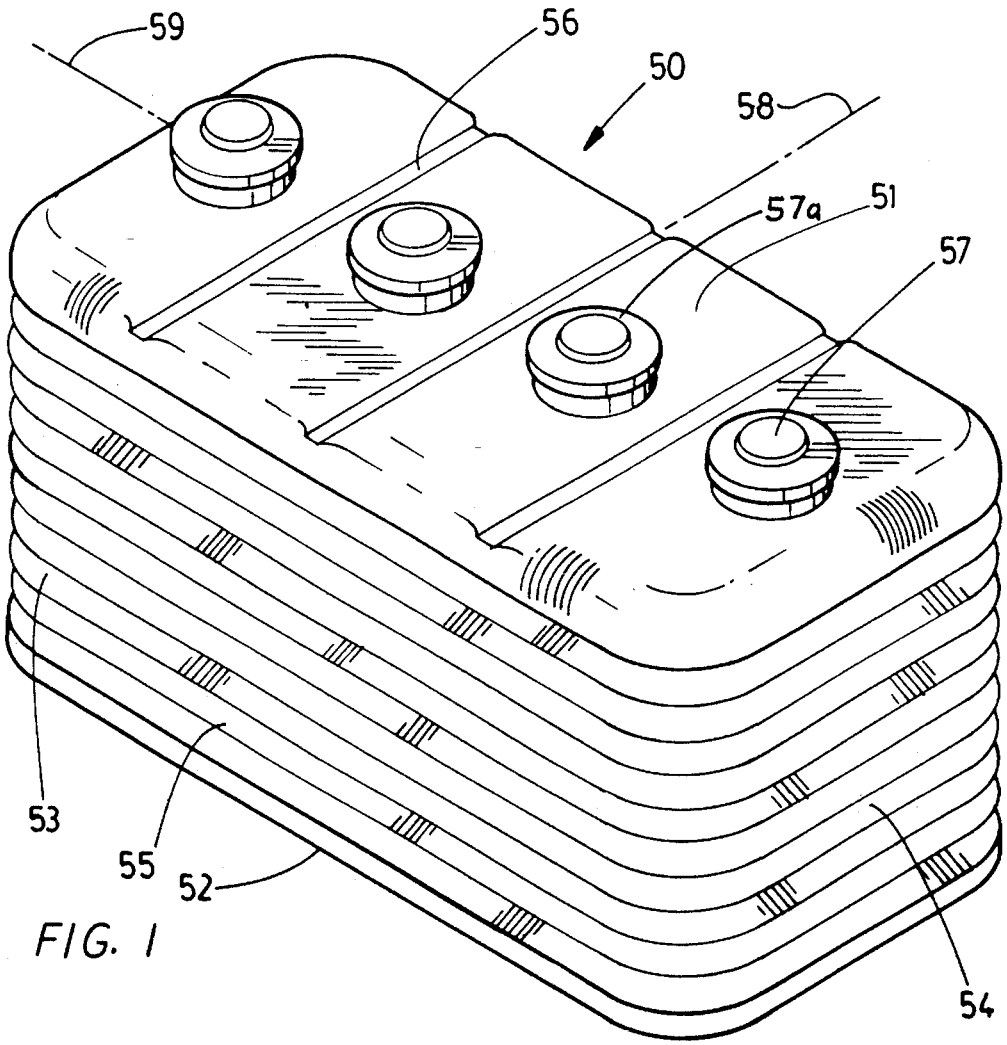
FIG. 1 is a perspective view of an embodiment of the invention with pleated side faces.
Figure 3:
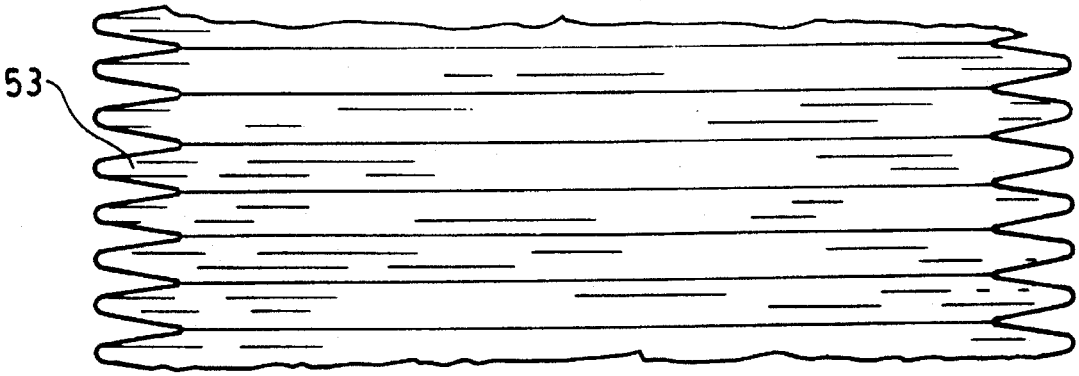
FIG. 3 is a partial end view of the pleated side wall of the block of FIG. 2, with the block partially collapsed.

FIG. 1 shows a perspective view of a block with pleated accordion-like sides. The block 50 has relatively flat top 51 and bottom 52 faces with outwardly directed exterior surfaces in the form of panels which are sufficiently thick to be relatively stiff. The encircling sides 53 delimiting the boundaries of the top 51 and bottom 52 faces have end 54 and face portions 55 which are pleated in an accordion-like manner to permit folding and compression of the sides 53, and thereby to provide for the collapse of the block, as shown in FIG. 3.

This block 50 is preferably blow-molded from polyethylene or polypropylene plastic, with a side-wall thickness on the order of 1 millimetre and preferably a thickness of 1–3 mm in the top 51 and bottom 52 panels. Inset ribs 56 may optionally traverse the top 51 and/or bottom 52 panels to increase stiffness. Further stiffening may be provided by additional ribs.

Preferred dimensions for the block are 24 to 30 cm long by 12 to 15 cm wide and by 12 to 15 cm high. However, the size of the blocks is not restricted to any specific specifications, and may be changed according to the purpose. The same applies in relation to the shape of the block, and the blocks can be made in the shape of half-blocks or trapezoidal shapes.

Protrusions 57 extend upwardly from the top panel 51 and are intended to inter-engage in sockets 65 in the bottom panel 52 and serve as attachment or coupling means. A preferred configuration for the protrusions 57 is to have a single row, centered on the longitudinal middle or median line 59 within the longitudinal median plane of the block 50 and symmetrically disposed about the transverse middle or median line 58 within the transverse median plane of the block 50.

Top and bottom faces 6, 8 may each contain two complimenatry VELCRO (TM) -type pads 14 as a means to attach completed blocks together to form a stacked structure.

Figure 2:
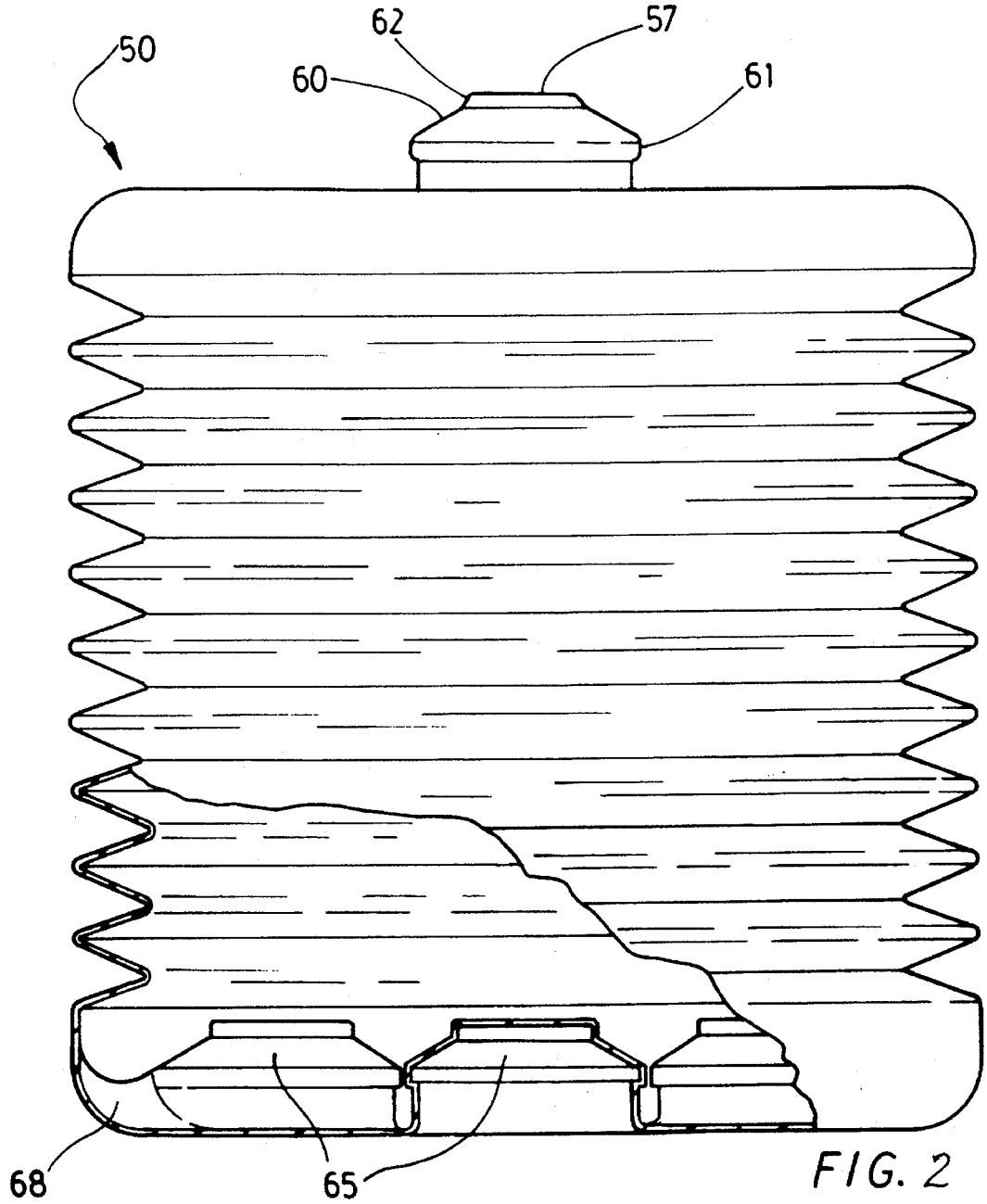
FIG. 2 is a cut-away end view of the pleated embodiment of FIG. 1 in fully erect, inflated form.

In FIG. 2 a profile end view of the block 50 shows that the protrusion 57 may have a tapered upper edge or shoulder 60 and a lip 61 to assist in assembly and in providing positive attachment.

Figure 4:
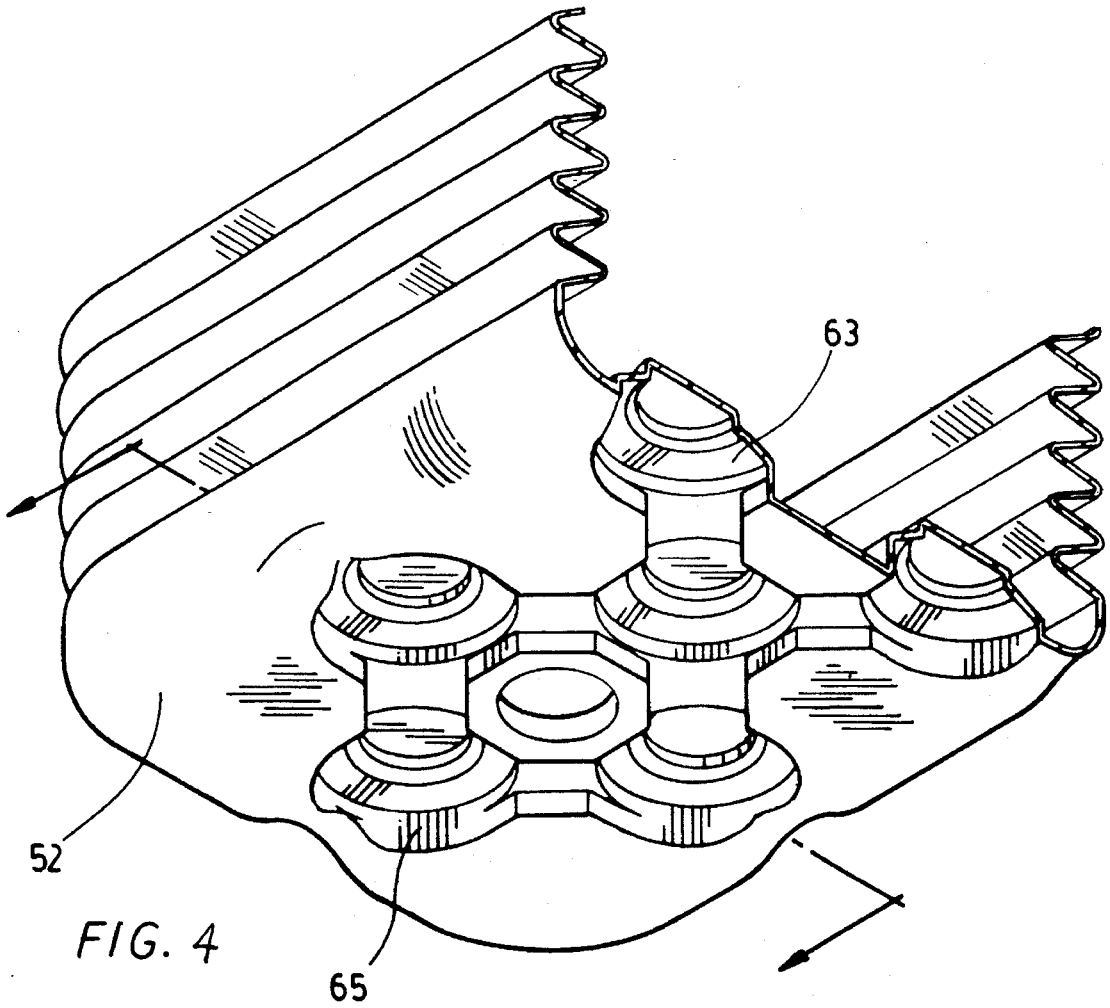
FIG. 4 is a perspective view of the bottom of a cross-sectioned block as in FIGS. 1–3.
Figure 5:
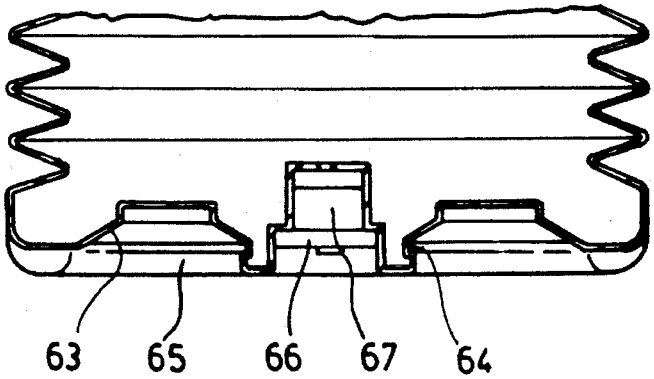
FIG. 5 is a detailed cross-section of the receptacle depressions formed in the bottom of the block of FIG. 4.

In FIGS. 4 and 5 the lower panel 52 with its complementary sockets 65 is depicted. The sockets 65 each have a tapered socket shoulder 63 over which the ends 62 of the protrusions 57 may slide as an alignment guide during assembly. Grooves 64 at the perimeter of the socket shoulder 63 engage the lips 61. These grooves 64 are shown as being provided with a circular rim 72. This rim 72 may be interrupted to form a series of protruding lugs 73 shown in one example in FIG. 8. Such lugs 73 will expand and release more readily than a continuous rim.

A sealable orifice in the form of valve well 66 is provided with a preferably self-closing valve 67 at its end, although a manually sealable orifice may also be employed. This valve may be opened, as by a pencil or finger, to allow air or other flowable substance to enter or escape from the block.

Figure 6:
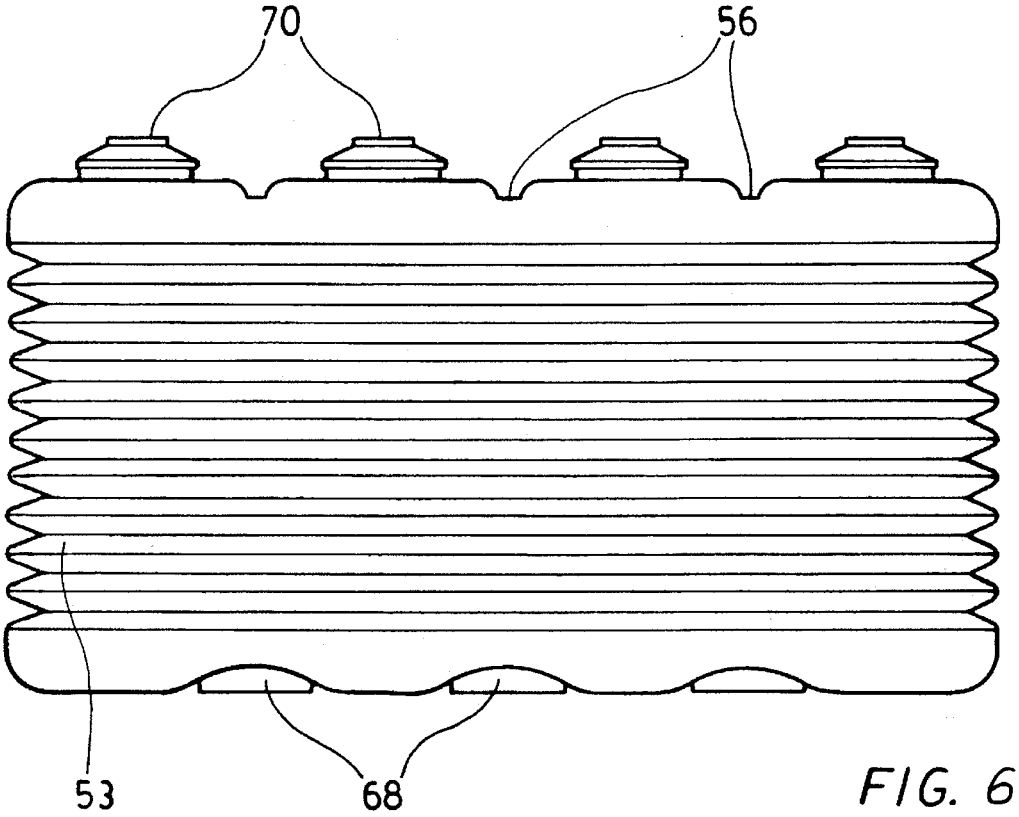
FIG. 6 is a face view of the block of FIG. 1 showing four coupling posts positioned on the top of the block.
Figure 7:
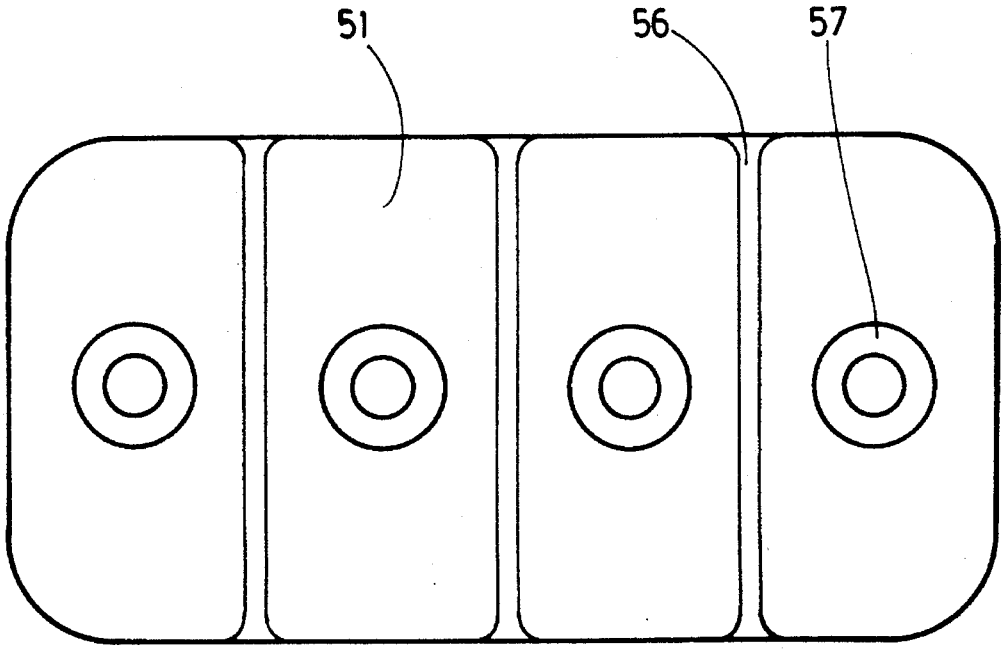
FIG. 7 is a top view of FIG. 6.

As shown in FIGS. 2 and 6 (only), the sides 53 of the block 50 are optionally provided with notches 68 along the perimeter of the bottom panel 52 to receive fingers during separation and disassembly of the blocks. These, as shown in FIGS. 4 and 6, may be positioned opposite sockets 65. The ribs 56, in the form of a depressed groove, as shown in FIG. 1, preferably extend to the outer edge of the block 50 where they can be seen. By locating the ribs 56 at regularly spaced intervals, their outer ends serve as alignment guides for fitting the protrusions 57 into the receptacles 65.

Figure 8:
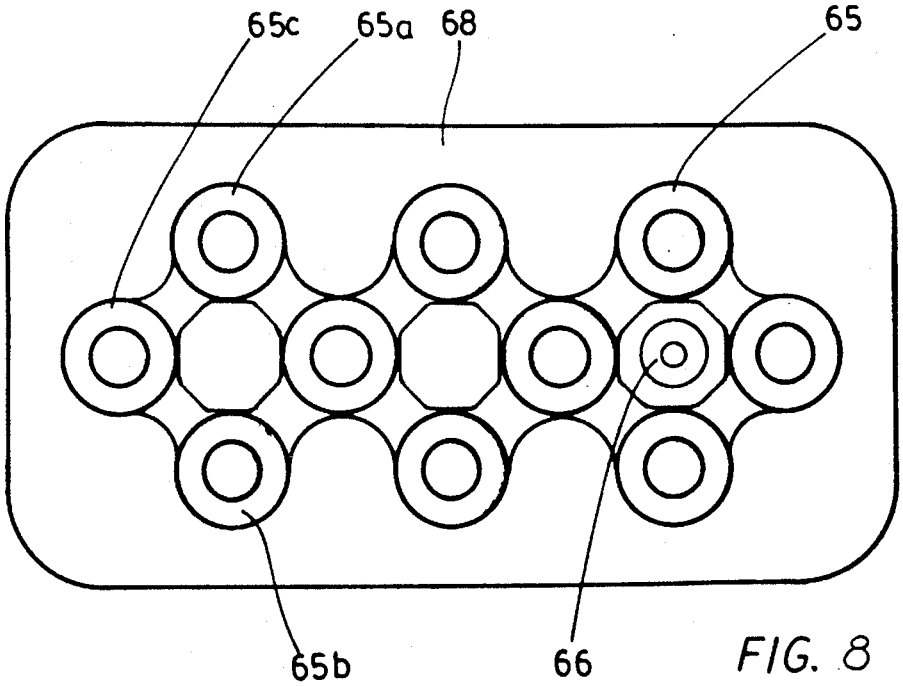
FIG. 8 is a bottom view of the block of FIGS. 1 and 7.

The sockets 65 may be laid-out in a multiple, overlapping cross-format, best seen in FIG. 8. This pattern of sockets 65 allows the blocks to be oriented at 90 degrees, if two sockets **65*a*, 65*b* are engaged by protrusions 57; or to swing over a range of degrees if a end socket 65*c* only is engaged by a single end protrusion 57. This range of motion is limited by interference between the first unengaged protrusion 57*a* and the top face 51**. This allows for more complex structures to be formed than that of a simple, planar wall.

While the blocks of FIG. 2 and 6 are intended to be stacked to form a wall structure having staggered, inter-engaged, over-lying courses with the pleated sides 93 forming the vertical sides, such blocks may also be stacked with the pleated sides 53 forming the top and bottom faces of the block.

Blocks according to the invention are suited to be stacked up by children to construct larger toy play structures than traditional sized blocks, optionally large enough to walk-into. They may also be used to create functional structures that benefit from the insulating qualities of air-filled blocks. Blocks of the invention may also be filled with water, sand or other flowing materials for such applications as flood or military use.

The blocks enjoy the advantage of being light and compact to store and transport. If made of polymer plastic, they are generally weather-proof. A further advantage is that when produced on a mass basis, such blocks should be relatively inexpensive.

Conclusion

The foregoing has constituted a description of specific embodiments showing how the invention may be applied and put into use. These embodiments are only exemplary. The invention in its broadest, and more specific aspects is further described and defined in the claims which now follow.

These claims and the language used therein, are to be understood in terms of the variants of the invention which have been described. They are not to be restricted to such variants, but are to be read as covering the full scope of the invention as is implicit within the invention and the disclosure that has been provided herein.

The embodiments of the invention in which an exclusive property or privilege is claimed are defined as follows:

1. A modular building block for constructing structures, such block having an interior which is hollow and comprising:

(1) a sealable orifice for introducing or releasing a flowable substance into the interior volume of the block;

(2) substantially stiff upper and lower opposed faces on such block;

(3) upper and lower surfaces on said upper and lower faces which permit said block to be stacked with other blocks to form a vertical wall;

(4) pleated side walls which are collapsible to permit compaction of the block for storage;

(5) coupling means associated with each block for engaging the block with another block, wherein said coupling means is only provided on the upper and lower faces of the block, positioned to render such blocks inter-engagable in staggered, over-lying courses to form a stable structure, wherein said upper and lower faces and side walls are integrally formed so as to be sealingly inter-connected and render the interior volume of the block air tight.

2. A block as in claim 1 wherein said coupling means comprises protrusions and sockets that are integrally formed with the top and bottom faces of the block, such protrusions and sockets being dimensioned to mutually interfit within each other and being respectively located within the boundaries of opposed top and bottom faces of the block so as to permit overlapping interengagement between blocks in successive courses within a wall.

3. A block as in claim 2 wherein said sockets are positioned within an upper or lower face of the block and said protrusions are positioned on the opposite face so as to permit an engagement between blocks within a wall of successive courses that allows the respective blocks in successive courses to assume a range of angular orientations with each other.

4. A block as in claim 3 having longitudinal and transverse median planes wherein:

(1) said protrusions comprise four protrusions positioned along the longitudinal median plane of the block, symmetrically about the transverse median plane of the block; and (2) said sockets comprise eight sockets, positioned in two cross-like formations of four sockets, symmetrically located about the transverse median plane of the block so as to provide four sockets positioned in a single row, along the longitudinal median plane of the block.

5. A block as in claim 4 comprising two additional sockets positioned between the cross-like formations of four sockets, along the transverse median plane of the block, such two additional sockets being symmetrically placed with respect to the longitudinal median plane of the block.

6. A block as in claim 1 having notches formed within the perimeter of the bottom face to receive fingers when the block is incorporated into a wall to facilitate separation of blocks.

7. A block as in claim 6 wherein said notches are formed adjacent to the sockets formed in the bottom face of the block.

8. A block as in claim 1 having transverse reinforcing ribs formed as a depression in the upper face of the block intermediate the protrusions to provide stiffening to the upper face and to serve as alignment guides for engaging the protrusions of one block with sockets on an adjacent block.

9. A block as in claim 1 wherein the protrusions have a tapered upper shoulder to assist in assembly of the protrusions with sockets.

10. A modular building block for constructing structures, such block having an interior which is hollow and air-tight and comprising:

(1) a sealable orifice for introducing or releasing a flowable substance into the interior volume of the block:

(2) upper and lower faces on such block;

(3) upper and lower surfaces on said upper and lower faces which permit said block to be stacked with other blocks to form a vertical wall;

(4) side walls which are collapsible to permit compaction of the block for storage;

(5) coupling means associated with each block for engaging the block with another block, wherein said coupling means is provided on the upper and lower faces of the block, positioned to render such blocks inter-engagable in staggered, over-lying courses to form a stable structure;

wherein:

(a) said coupling means comprises protrusions and sockets that are dimensioned to mutually interfit within each other;

(b) said sockets are positioned within an upper or lower face of the block and said protrusions are positioned on the opposite face so as to permit an engagement between blocks that allows the respective blocks to assume a range of angular orientations with each other;

(c) said sockets comprise eight sockets, positioned in two cross-like formations of four sockets, symmetrically located about the transverse median plane of the block and with four sockets positioned along the longitudinal median plane of the block; and (d) said protrusions comprise at least two protrusions positioned along the longitudinal median plane of the block, symmetrically about the transverse median line of the block at positions corresponding to the position of the outer two sockets located along the longitudinal median plane of the block.

11. A block as in claim 10 having four protrusion positioned in a single row along the longitudinal median plane of the block.

12. A block as in claim 10 comprising two additional sockets positioned between the cross-like formations of four sockets, along the transverse median plane of the block, such two additional sockets being symmetrically placed with respect to the longitudinal median plane of the block for interengagement with protrusions on an adjacent block.

13. A block as in claim 10 wherein the upper and lower faces and side walls are integrally formed and interconnected with each other.

14. A block as in claim 10 wherein said protrusions and sockets are integrally formed with the top and bottom faces of the block.

15. A block as in claim 14 having four protrusions positioned in a single row along the longitudinal median plane of the block.

16. A block as in claim 10 having notches formed within the perimeter of the bottom face to receive fingers when the block is incorporated into a wall to facilitate separation of blocks.

17. A block as in claim 16 wherein said notches are formed adjacent to the sockets formed in the bottom face of the block.

18. A block as in claim 10 having transverse reinforcing ribs formed as a depression in the upper face of the block intermediate the protrusions to provide stiffening to the upper face and to serve as alignment guides for engaging the protrusions of one block with sockets on an adjacent block.

19. A block as in claim 10 wherein the protrusions have a tapered upper shoulder to assist in assembly of the protrusions with sockets.

20. A modular building block for constructing structures, having upper and lower faces and longitudinal and transverse median planes comprising coupling means associated with each block for engaging the block with another block, positioned to render such blocks inter-engagable in staggered, over-lying courses to form a stable structure, wherein:

(1) said coupling means comprises protrusions and sockets formed on the top and bottom faces of the block, such protrusions and sockets being dimensioned to mutually interfit within each other and being respectively located so as to permit overlapping interengagement between blocks in successive courses within a wall, (2) said protrusions comprising four protrusions positioned on one face of the block along the longitudinal median plane of the block, symmetrically about the transverse median plane of the block; and (3) said sockets comprising eight sockets, positioned on an opposed face of the block to the face having protrusions, the eight sockets being in two cross-like formations of four sockets, symmetrically located about the transverse median plane of the block so as to provide four sockets positioned in a single row, along the longitudinal median plane of the block.

21. A block as in claim 20 comprising two additional sockets positioned between the cross-like formations of four sockets, along the transverse median plane of the block, such two additional sockets being symmetrically placed with respect to the longitudinal median plane of the block.

22. A modular building block for constructing structures, such block having upper and lower faces and longitudinal and transverse median planes and comprising coupling means associated with each block for engaging the block with another block, wherein said coupling means is provided on the upper and lower faces of the block, positioned to render such blocks inter-engagable in staggered, over-lying courses to form a stable structure; wherein:

(1) said coupling means comprises protrusions and sockets that are dimensioned to mutually interfit within each other;

(2) said sockets are positioned within an upper or lower face of the block and said protrusions are positioned on the opposite face so as to permit an engagement between blocks that allows the respective blocks to assume a range of angular orientations with each other;

(3) said sockets comprise eight sockets, positioned in two cross-like formations of four sockets, symmetrically located about the transverse median plane of the block and with four sockets positioned along the longitudinal median plane of the block; and (4) said protrusions comprise at least two protrusions positioned along the longitudinal median plane of the block, symmetrically about the transverse median line of the block at positions corresponding to the positions of the outer two sockets located along the longitudinal median plane of the block.

23. A block as in claim 22 having four protrusions positioned in a single row along the longitudinal median plane of the block.

24. A block as in claim 22 comprising two additional sockets positioned between the cross-like formations of four sockets, along the transverse median plane of the block, such two additional sockets being symmetrically placed with respect to the longitudinal median plane of the block for interengagement with protrusions on an adjacent block.

* * * * *